US005259178A

United States Patent [19]

Sostegni

[11] Patent Number: 5,259,178

[45] Date of Patent: Nov. 9, 1993

[54] MACHINE FOR MAKING CHENILLE YARNS

[76] Inventor: Giuliano Sostegni, Via Baldanzese, 247, Claenzaho, Firenze, Italy

[21] Appl. No.: 938,017

[22] Filed: Aug. 28, 1992

[30] Foreign Application Priority Data

Sep. 24, 1991 [IT] Italy ..... 91 A/238

[51] Int. Cl.[5] ..... D02G 3/42

[52] U.S. Cl. ..... 57/24

[58] Field of Search ..... 28/144, 163, 165, 169; 57/24, 905, 203, 264, 13, 3, 10, 120, 127.5

[56] References Cited

U.S. PATENT DOCUMENTS

| | | | |
|---|---|---|---|
| 1,488,795 | 4/1924 | Morton | 28/144 |
| 1,601,388 | 4/1931 | Ruf | 57/24 |
| 3,357,166 | 12/1967 | McCarthy | 57/24 |
| 3,869,850 | 1/1973 | Gross | 57/24 |
| 3,929,268 | 12/1975 | Gross | 28/144 |
| 4,517,715 | 5/1985 | Yoshida et al. | 28/144 |

*Primary Examiner*—Clifford D. Crowder

*Assistant Examiner*—Larry D. Worrell, Jr.

[57] ABSTRACT

Improved machine for making chenille yarns wherein the draw/counterdraw rollers (1,3) are mounted on a support (10) vertically oscillating in such ways as to move close to and respectively away from the gauge (2), with an arm (11) having a fine-thread screw register (13) and with stoppage of the rollers (1) before they touch the gauge (2). The shaft (12) of the draw/counterdraw rollers (1,3) is interlocked to a translation device able to adjust the axial position thereof. The rotary disk blade (4) for cutting the fuzzy thread is mounted on a shaft (40) whose ends are supported by bearings (41) and is lubricated and adjustable in height. The rotary head (6) for winding the fuzzy thread on the gauge (2) is mounted on a shaft (60) which is fitted on bearings (61) within a support (62) adjustable in height a fine-thread screw register (63). The gauge (2) is mounted on a slide (20) movable on a horizontal guide and whose position is adjustable by a fine-thread screw register (21).

12 Claims, 4 Drawing Sheets

MACHINE FOR MAKING CHENILLE YARNS

FIELD OF THE INVENTION

The present invention refers to some improvements in mchines for the production of chenille yarns and, more particularly, in the group for the formation of the yarn.

BACKGROUND OF THE INVENTION

A chenille yarn is known made up of two interweaving threads which are suitably twisted to engage lengths of a fuzzy thread. To this end, any chenille-making machine comprises a yarn-forming group with a "gauge" or winding plate for the winding and sizing of the fuzzy thread, a blade for cutting lengths of fuzzy thread, two draw rollers with relevant counterdraw rollers for feeding the interweaving threads along with lengths of fuzzy thread and means for twisting the interweaving threads with interposed lengths of fuzzy threads.

Following the ever growing requirements of the industrial sector such as a higher production and improved product quality, numerous problems are still to be solved to build chenille-producing machines capable of meeting such requiremnts.

SUMMARY AND OBJECTS OF THE INVENTION

The present invention has the object to provide a yarn-forming group for a machine of very high output per hour and able to produce chenille of very high quality. To achieve this object the major problems to be overcome are the following: the precise adjustment of the draw/counterdraw rollers with respect to the gauge to prevent them from pressing on same gauge; the precise adjustment of the draw/counterdraw rollers with the machine being in operation to allow—along with the combined registration of the gauge—for the positioning of the interweaving thread and the centering thereof with respect to the relevant gauge hole; the precise adjustment of the rotary cutting blade with the machine being in operation to prevent the contact with the gauge; the provision of a head for winding the fuzzy thread on the gauge and suited for very high rotary speeds.

These results have been achieved, according to the invention, by adopting the idea of: providing the draw/-counterdraw rollers with a vertically oscillating support which has a fine-thread screw register allowing said rollers to take up a final position prior to their impact against the gauge and, besides, providing the shaft of the draw/counterdraw rollers with means for the axial adjustment thereof; lubricating the rotary blade for cutting the fuzzy thread and providing the same blade with a shaft having end supports; mounting the head shaft, for the winding of the fuzzy thread over the gauge, on bearings and lubricating it and, besides, providing the relevant support with a vertical, fine-thread screw register; and finally mounting the gauge on a horizontal bracket whose position is adjustable by means of fine-thread screw register. The joint solution of these problems has made it possible to provide a chenille yarn-forming group for a machine which as a result is more competitive, as it achieves several significant objects at the same time consisting in the fact that it is possible to achieve a fast, accurate and sensitive adjustment of the draw and counter-draw rollers with respect to the gauge while said machine is in operation; that it is possible, by only one operation, to accomplish the adjustment of the interweaving threads and the centering thereof with respect to the gauge outlet; that it is possible to adjust precisely the gauge while the machine is in operation to achieve the optimal position of the thread; that it is possible to provide an increased speed of the rotary head which drives the fuzzy thread into winding engagement onto the gauge while adjusting the position thereof in height; that it is possible to improve the cutting of the fuzzy thread owing to the fact that the rotary blade is perfectly centered inside the gauge and is properly lubricated; that it is possible to reduce the service stops owing to the fact that lubrication devices are mounted on all the rotating parts.

BRIEF DESCRIPTION OF THE DRAWINGS

These and other advantages and characteristics of the invention will be best understood by anyone skilled in the art from a reading of the following description in conjunction with the attached drawings given as a practical examplification of the invention, but not to be considered in a limitative sense; wherein.

DETAILED DESCRIPTION OF THE PREFERRED EMBODIMENT

Figure 1:
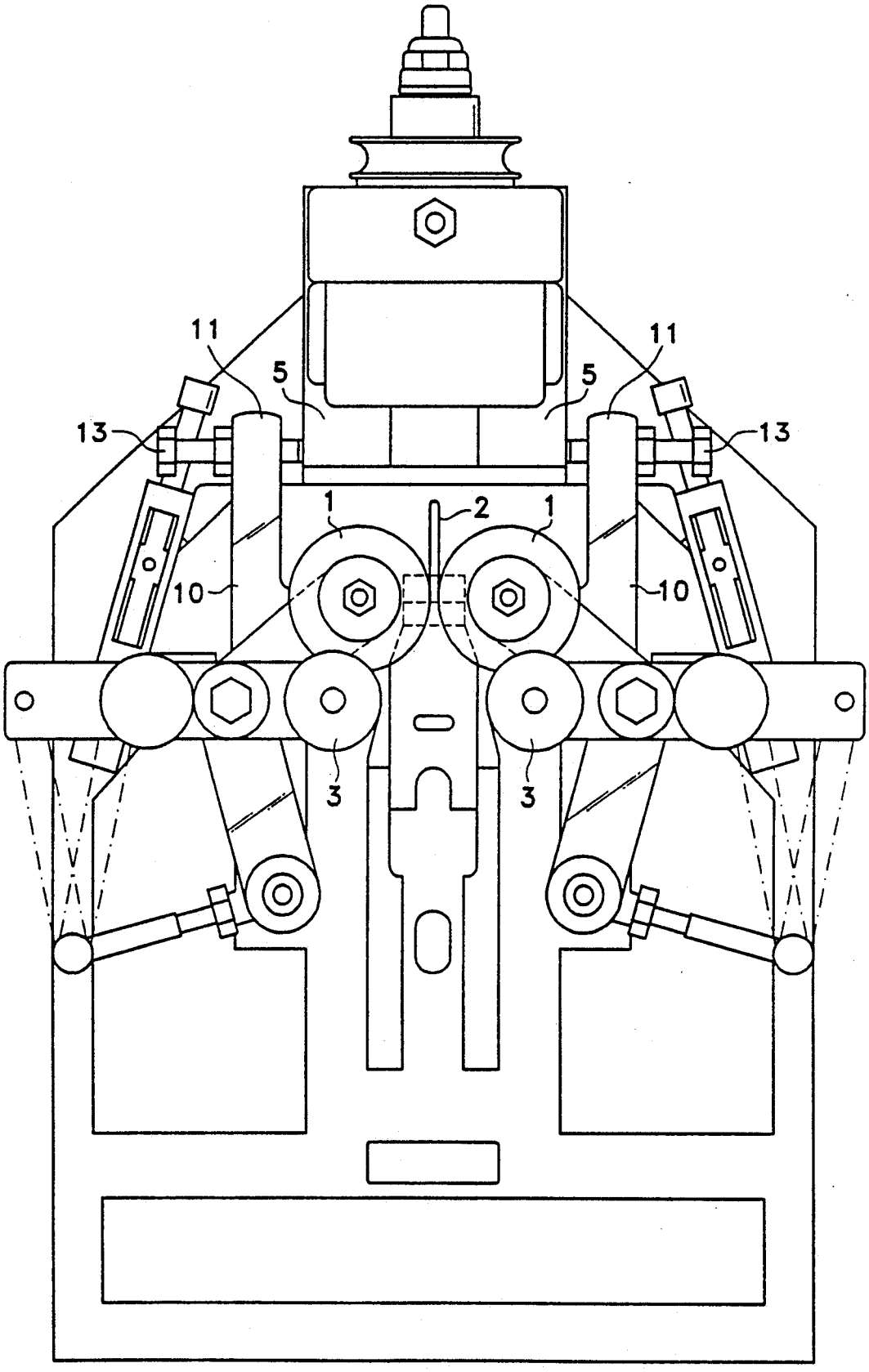
FIG. 1 shows the front ensemble view of the thread-forming group for an improved chenille-making machine according to the invention.
Figure 2:
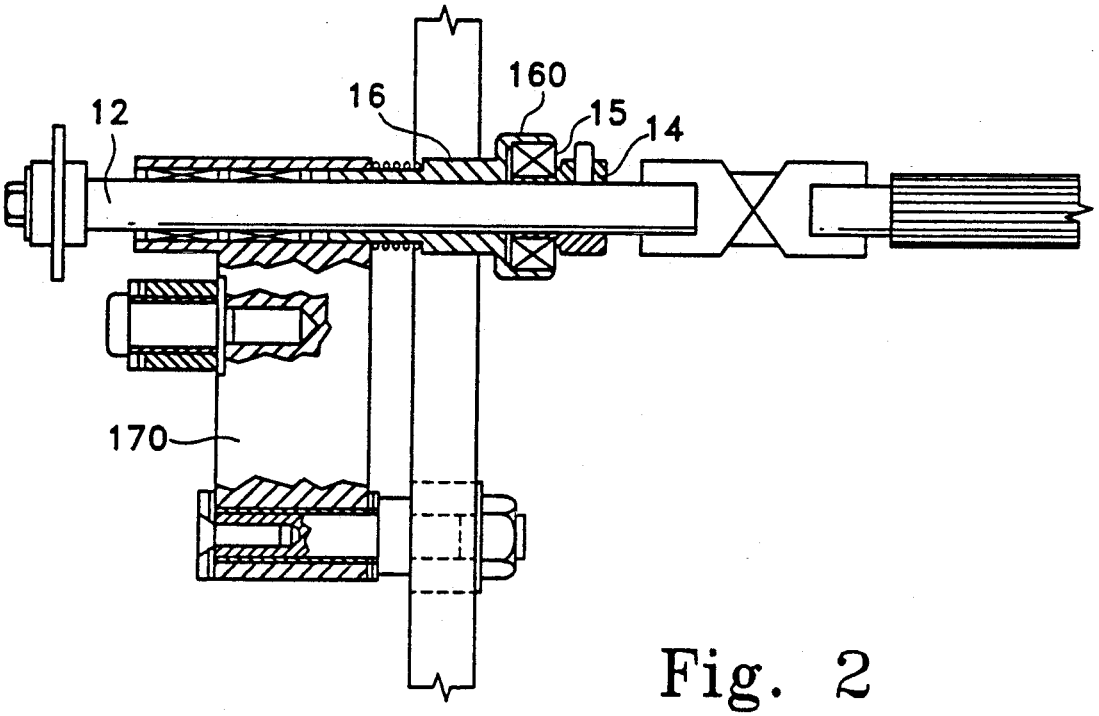
FIG. 2 shows the detail partly in section of the draw rollers adjustment means.
Figure 3:
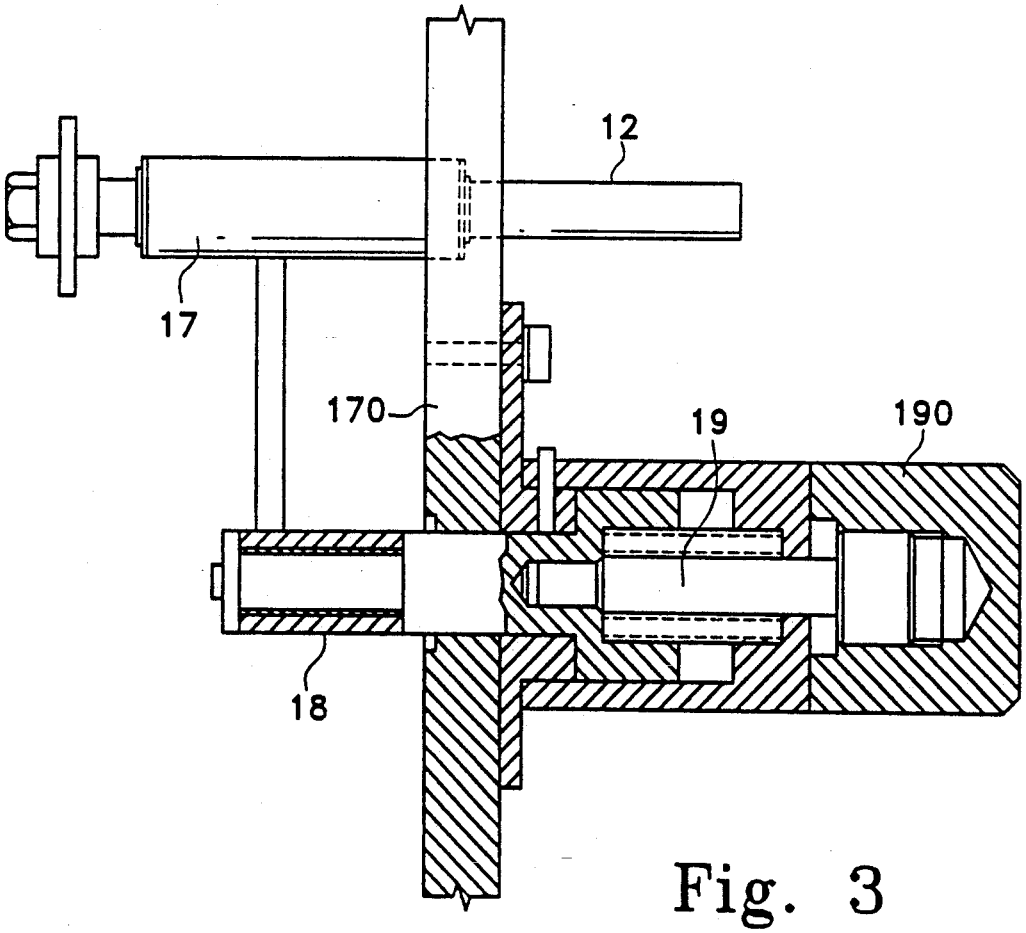
FIG. 3 shows a modified embodiment of the adjustment means of FIG. 2.
Figure 4:
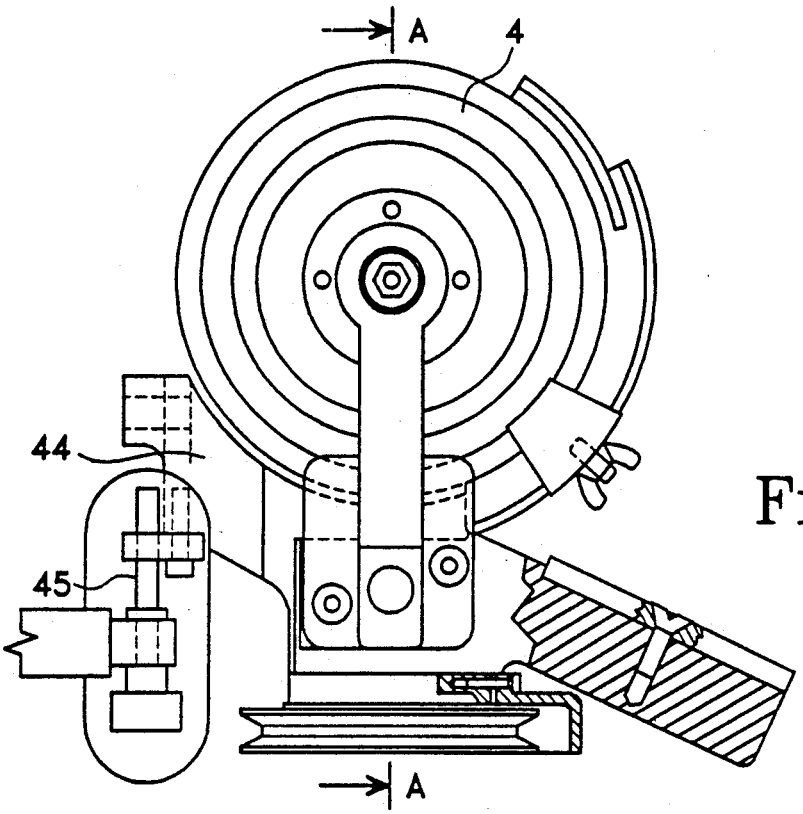
FIG. 4 shows the front view of the detail of the rotary cutting blade.
Figure 5:
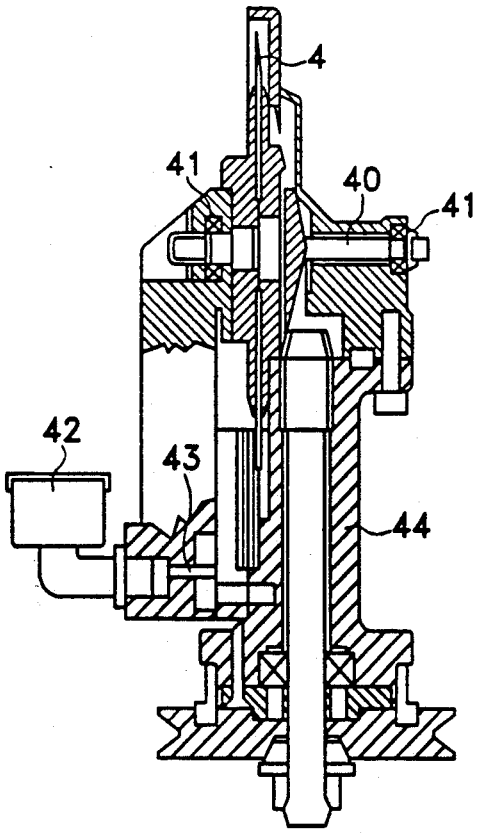
FIG. 5 shows a section taken on line A—A of FIG. 4.
Figure 6:
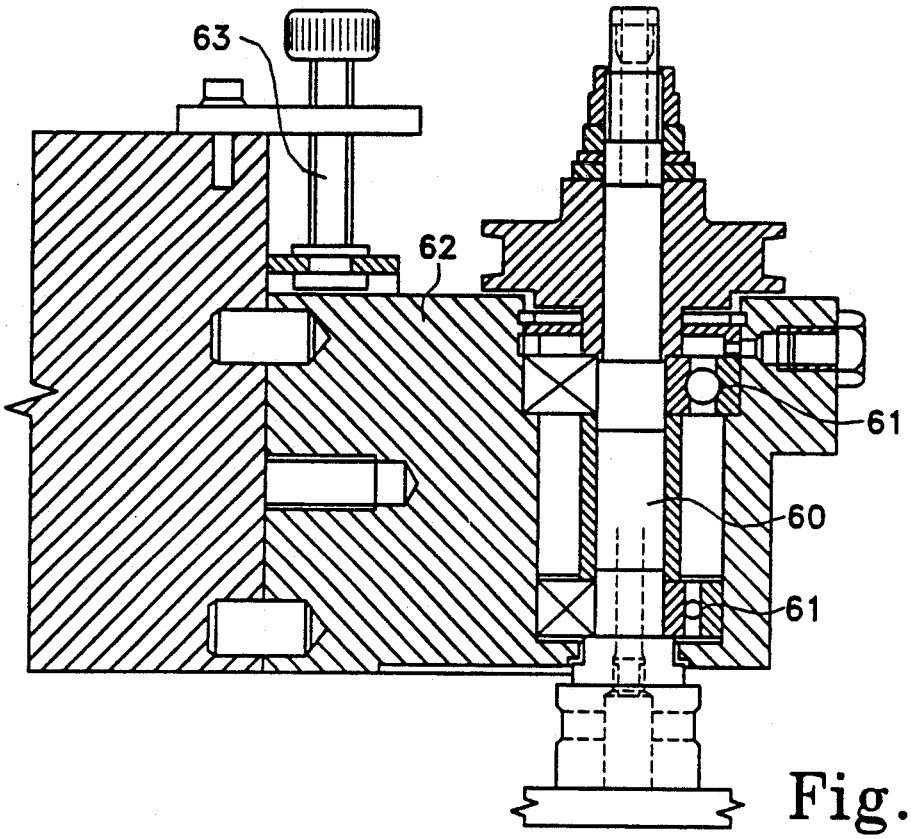
FIG. 6 shows a section view of the detail of the head for the winding of the fuzzy thread.
Figure 7:
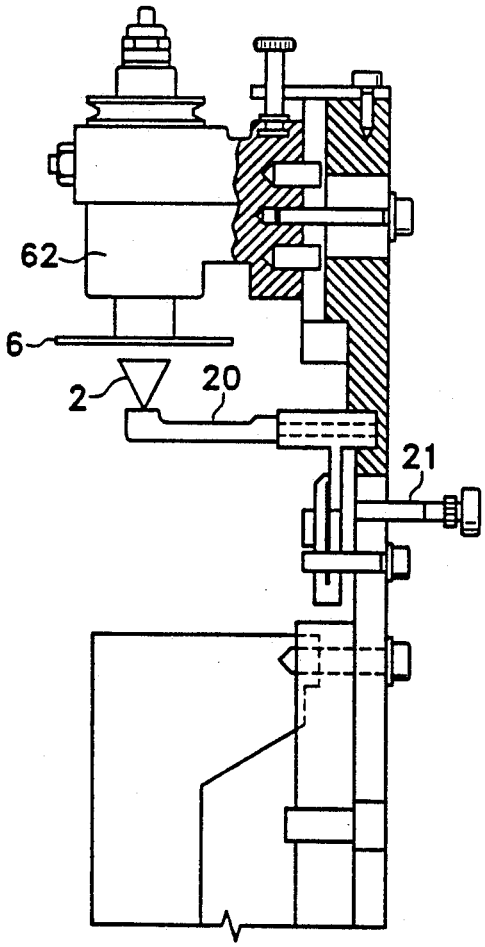
FIG. 7 shows the detail of the gauge-adjusting means.

Reduced to its basic structure and with reference to the accompanying drawings, an improved machine for chenille yarns, according to the invention, comprises:

means for driving the interweaving thread with draw rollers 1,3 mounted on a support 10 vertically oscillating to move close to and away from, respectively, the gauge 2 and provided with an upwardly projecting arm 11 and a fine-thread screw register 13 going therethrough whose shank makes up an abutment and stop means against the fixed part 5 of the machine so that, after a fast movement of the draw rollers 1 and counterdraw rollers 3 close to gauge 2, it allows an accurate adjustment of same rollers, with final stoppage thereof before they come in contact with the gauge 2. Moreover, fixed on the shaft 12 of the draw/counterdraw rollers 1,3 is a ferrule 14 fitted on a bearing 15, the latter having a barrel 16 with a knob 160 mounted thereon, the same barrel being idly mounted on the shaft 12 and provided with inner threads for engaging a corresponding nut of the support 170 of shaft 12 so that, by rotating the knob 160 in one direction or the other, there is obtained the translation of shaft 12 of the draw/counterdraw rollers 1,3 in one direction or the other.

Alternatively, the shaft 12 is provided with a sleeve 17 and spacer rings, is idly fitted into the support 170 and is solid to a bush 18 axially engaged by the shank of the adjusting screw 19, the latter being operable through the knob 190 so that, by rotating the knob 190 in one direction or the other, the bush 18 with the sleeve 17 and shaft 12 cause the translation of shaft 12 of the draw/counterdraw rollers 1,3 in one direction or the other;

means for cutting the fuzzy thread, whose rotary blade 4 is mounted on a shaft 40 the ends of which are supported by bearings 41, and whose support 44 is adjustable in height by a fine-thread screw register 45; said blade 41 being further lubricated by a liquid lubricant which is fed from a reservoir 42 through at least a conduit 43;

means for winding the fuzzy thread on the gauge 2 by means of a head 6 whose lubricated shaft 60 is mounted on bearings 61 and whose support 62 is adjustable in height by a fine-thread screw register 63;

means for horizontally adjusting the gauge 2, the latter being mounted on a horizontally guided slide 20 which can be adjusted by a fine-thread screw register.

Practically, all the construction details may vary in any equivalent way as far as the form, dimensions, elements disposition, nature of the used materials are concerned, without nevertheless departing from the scope of the adopted solution idea and, thereby, remaining within the limits of the protection granted to the present patent for industrial invention.

I claim:

1. A machine for making chenille yarns, comprising: a gauge; a gauge slide mounting support, said slide mounting support being movable on a horizontal guide with said gauge mounted thereon; gauge slide adjustment means including a gauge fine-thread screw register for adjusting a position of said slide mounting support; draw/counterdraw rollers; a shaft for each draw/counterdraw rollers; a draw/counterdraw roller mounting support vertically moveable for oscillating movement close to and away from said gauge; a drive means for driving said draw/counterdraw rollers; adjustment means for adjusting a position of said draw/counterdraw roller mounting support, including an arm provided with a draw/counterdraw roller fine-thread screw register and with a stoppage element for stopping movement of said draw rollers before they touch said gauge; a translation means interlocked with each said shaft of said draw/counterdraw rollers for adjustment of an axial position of said shaft of said draw/counterdraw rollers; a rotary blade for cutting a fuzzy thread; a cutter shaft, said rotary blade being mounted on said cutter shaft, said cutter shaft having ends supported by bearings; a rotary head positioned for winding said fuzzy thread on said gauge; a rotary head shaft fitted on rotary head shaft bearings, said rotary head being mounted on said rotary head shaft; a rotary head shaft support, said rotary head shaft support containing said rotary head shaft bearings, said rotary head shaft support being adjustable in height by a rotary head shaft support adjustment means including a rotary head shaft support fine-thread screw register, and bearing lubrication and adjustment means for lubricating said bearings and adjusting a position of said bearings in height.

2. A machine according to claim 1, wherein said arm of said draw/counterdraw roller support is upwardly projecting, engaged with said draw/counterdraw roller fine-thread screw register, a shank of said draw/counterdraw roller screw register forming an abutment of said stoppage element, acting as a stop against said rotary head which forms a fixed part of the machine.

3. A machine according to claim 2, wherein said draw/counter draw roller fine-thread screw register is operable for adjustment during operation of the machine.

4. A machine according to claim 1, wherein said translation means includes a barrel mounted idly on each said draw/counterdraw roller shaft, said barrel being threaded to engage a corresponding nut of a shaft support, said shaft support being provided with a knob wherein rotation of said knob in one direction or the other causes translation of a respective shaft in one direction or the other.

5. A machine according to claim 4, wherein said knob of said barrel is fitted on a bearing fixed to each said shaft through a ferrule.

6. A machine according to claim 1, wherein said translation means includes an axial translation means fine-thread adjusting screw engaging a bush which passes through a draw/counterdraw roller shaft support, and is parallel and fixed to a barrel idly mounted on each said draw/counterdraw roller shaft between two spacer rings.

7. A machine according to claim 6, wherein each said axial translation means adjusting screw includes a handling knob wherein rotation of said handling knob in one direction or the other causes translation of said draw/counterdraw roller shaft in one direction or the other.

8. A machine according to claim 7, wherein each said handling knob is rotatable to cause translation of a respective draw/counterdraw roller shaft during operation of the machine.

9. A machine according to claim 4, wherein said blade shaft is mounted on an adjustable blade shaft support, said blade shaft support including adjustment means with a blade fine-thread adjusting screw.

10. A machine according to claim 9, wherein said blade fine-thread adjusting screw is operable during operation of the machine.

11. A machine according to claim 9, wherein said blade shaft support is connected to a reservoir which feeds lubricating liquid to said rotary blade, through at least one feeding conduit.

12. A machine according to claim 1, wherein said gauge fine-thread screw register is adjustable during operation of the machine.

* * * * *